US009530390B1

(12) United States Patent
Hildner

(10) Patent No.: US 9,530,390 B1
(45) Date of Patent: Dec. 27, 2016

(54) PILLOW PRACTICE PAD FOR DRUMMERS

(71) Applicant: Paul Davis Hildner, New York, NY (US)

(72) Inventor: Paul Davis Hildner, New York, NY (US)

( * ) Notice: Subject to any disclaimer, the term of this patent is extended or adjusted under 35 U.S.C. 154(b) by 0 days.

(21) Appl. No.: 15/157,375

(22) Filed: May 17, 2016

Related U.S. Application Data

(60) Provisional application No. 62/163,254, filed on May 18, 2015.

(51) Int. Cl.
*G10D 13/02* (2006.01)

(52) U.S. Cl.
CPC ..... *G10D 13/029* (2013.01)

(58) Field of Classification Search
CPC ..... G10D 13/029
See application file for complete search history.

(56) References Cited

U.S. PATENT DOCUMENTS 1,346,588 A * 7/1920 Bower ..... G10D 13/029 84/411 P
3,264,926 A * 8/1966 Belli ..... G10D 13/029 84/411 R
3,597,520 A 8/1971 Andrews
4,102,235 A * 7/1978 Le Masters ..... G10D 13/06 84/411 M
4,179,974 A * 12/1979 Trankle ..... G10D 13/029 84/411 P
4,406,207 A * 9/1983 Criscione ..... G10D 13/029 84/411 P
4,745,839 A * 5/1988 Peraino ..... G10D 13/022 84/411 M
5,088,376 A * 2/1992 Crago ..... G10D 13/022 84/411 M
5,107,741 A * 4/1992 Beals ..... G10D 13/022 84/411 M
5,233,898 A * 8/1993 Montano ..... G10D 13/022 181/207
5,492,047 A 2/1996 Oliveri
5,520,090 A * 5/1996 Eagle ..... G10D 13/029 84/411 P
5,929,354 A * 7/1999 Davis ..... G10D 13/029 84/411 P
5,932,823 A * 8/1999 Jacobs ..... G10D 13/029 428/411.1
6,043,420 A * 3/2000 Arnold ..... G10D 13/022 84/411 M
6,573,441 B2 * 6/2003 Norris, Jr. ..... G10D 13/022 84/411 M (Continued)

OTHER PUBLICATIONS

Falk, Jared, Practice Drums on a Pillow, Sep. 20, 2013, viewed at http://www.drumeo.com/blog/practice-pillow/ on Aug. 23, 2016.*

*Primary Examiner* — Robert W Horn

(57) ABSTRACT

A two-part pillow practice pad assembly is provided as an aid to practicing the drums and improving drumming technique. In an embodiment, the two-part pillow practice pad assembly may have a resilient, non-rebounding upper pillow section, and a lower, weighted pillow section. The weighted lower pillow section prevents the pillow practice pad assembly from moving or migrating during use. In an embodiment, the upper and lower pillows are detachably fastened together.

16 Claims, 2 Drawing Sheets

(56) References Cited

U.S. PATENT DOCUMENTS

| | | | | |
|---|---|---|---|---|
| 6,684,429 | B1 * | 2/2004 | Deering | A47C 7/383 5/636 |
| 7,348,479 | B1 * | 3/2008 | Lombardi | G10D 13/029 84/422.1 |
| 7,351,898 | B2 | 4/2008 | Sagastegui | |
| 7,498,499 | B2 | 3/2009 | Sharp | |
| 7,638,701 | B2 | 12/2009 | May | |
| 7,723,593 | B1 | 5/2010 | Prentice et al. | |
| 7,777,113 | B1 | 8/2010 | Chang | |
| 7,985,908 | B1 | 7/2011 | Howard et al. | |
| 8,410,345 | B2 * | 4/2013 | Patrick | G10D 13/022 84/411 M |
| 8,629,339 | B1 | 1/2014 | Liao | |
| 9,330,642 | B2 * | 5/2016 | Nicholson | G10D 13/022 |
| 2008/0148921 | A1 * | 6/2008 | Calder | G10D 13/022 84/411 M |
| 2014/0238216 | A1 | 8/2014 | Mino | |
| 2015/0096428 | A1 | 4/2015 | Coheley | |

* cited by examiner

PILLOW PRACTICE PAD FOR DRUMMERS

CROSS REFERENCE TO RELATED APPLICATION

This application claims priority to provisional application No. 62/163,254, filed May 18, 2015, the entire contents of which are incorporated herein by reference.

FIELD OF THE INVENTION

This invention pertains to an apparatus and method for practicing drums.

BACKGROUND

The use of pillows by drummers to practice and improve their technique is a well-known method. The general idea of using a non-rebounding surface, such as by striking a pillow with drum sticks, is accepted by many experts as a valuable aid to practicing drumming technique. The use of a pillow as a non-rebounding surface is said to be a helpful aid in developing muscles, wrist technique, and finger technique that cannot be developed as easily on a practice pad or conventional drum surface with normal rebound when struck by drum sticks. The use of a pillow forces the drummer to strike each note without the aid of rebound, which is a very beneficial practice aid.

Moreover, practicing drumming on a pillow is quiet, so it does not disturb others, which can be a limiting factor for drumming practice.

Typical instructions for practicing on a pillow suggest using an ordinary household pillow and placing on a table or a drum. When using a pillow in this fashion, the pillow will have a tendency to shift position, which is undesirable. Moreover, finding an appropriately sized pillow with optimum rebound and surface characteristics can be challenging.

BRIEF SUMMARY

In an embodiment, a practice pillow assembly is provided with two discrete sections. Each section is generally circular and about 12" in diameter. The sections may include an upper section and a lower section that are stacked together. The two sections may be fastened together.

In an embodiment, the upper section may have cotton/polyester blend outer shell and is packed with a fiberfill material. The pillow is resilient but firm and has minimal rebound when struck with drum sticks. In an embodiment, the upper section is about 2.5" thick at the thickest part.

In an embodiment, the lower section is made from a heavier material such as canvas. In an embodiment, the lower section is packed with a heavy flowable material, for example sand or ball bearings, that acts as a weight to prevent the pillow practice pad assembly from moving during use. The lower section may be about 0.5" thick. In an embodiment, the lower section is filled with about 2.5 lbs. (1.1 kg) of the flowable material. The canvas outer material is generally non-skid to reduce the tendency of the assembly to move when in use.

In operation, the weighted lower section effectively anchors the assembly preventing it from moving during use.

In an embodiment, the upper and lower sections are detachable. The two sections may be fastened together with hook and loop fasteners (for example VELCRO®), a zipper, or snaps.

In an embodiment, the bottom surface is rubberized to further prevent it from moving when in use.

In an embodiment, a method is provided of practicing drums using the two-part assembly. A drummer will place the pillow practice pad on a suitable surface at the position a drum would normally be placed. The drummer can then strike the inventive pillow practice pad with drum sticks to practice. The inventive pillow practice pad will not migrate, and is very quiet.

DETAILED DESCRIPTION

This invention provides a pillow assembly for practicing drums that provides numerous benefits to the user. The user of the pillow practice pad is a student of the drums.

The pillow practice pad assembly 10 has a generally horizontal orientation for lying flat on a supporting tabular surface, with upper and lower surfaces. The upper face 130 faces upward when oriented as the assembly is resting on a surface ready for use or in use, and the lower face 230 faces downward and is in contact with the supporting surface.

In an embodiment, discrete upper and lower pillows are provided, wherein each pillow has a generally circular shape of about 8" to about 16" (about 20 cm to about 41 cm) in diameter on the horizontal axis. In an embodiment, each pillow is about 10" to about 14" in diameter (about 25 cm to about 36 cm). In an embodiment, each pillow is about 12" in diameter (about 30.5 cm). The two pillows may be fastened together in a stacked orientation. These measurements are from a circumferential seam that encloses the stuffing in each pillow, and are not intended to include any lip of fabric extending beyond the seam.

Figure 1:
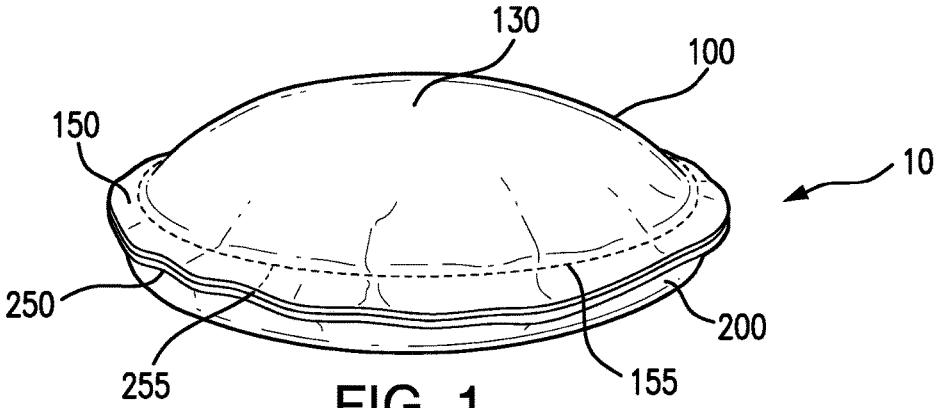
FIG. 1 shows a perspective view of the inventive pillow practice pad.
Figure 2:
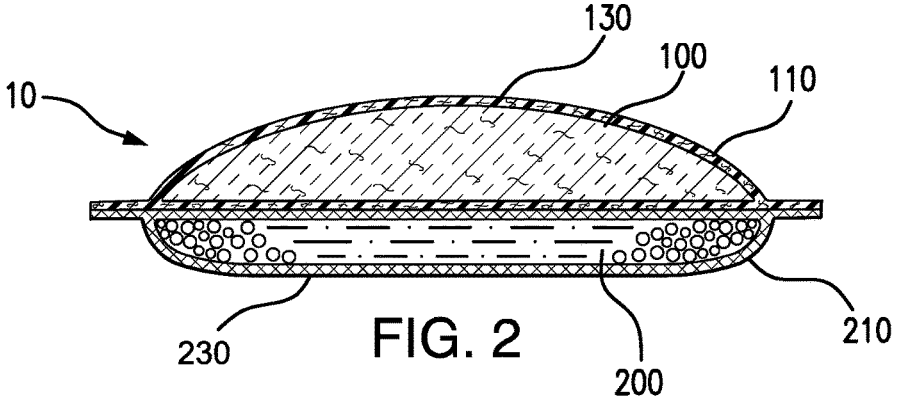
FIG. 2 shows an elevation view of the inventive pillow practice pad.
Figure 3:
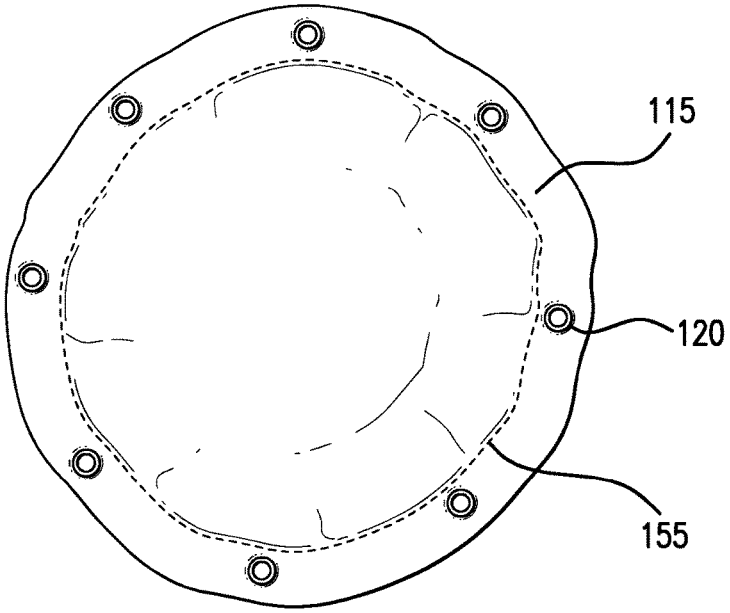
FIG. 3 shows an elevation view of the bottom surface of the upper pillow.

In an embodiment, the upper pillow 100 has a cotton/polyester blend outer shell 110 and is packed with a resilient material, such as a polyester fiberfill. The circumferential seam 155 defines the edge of the pillow. In an embodiment, the outer shell defining the pillow may extend beyond the seam as illustrated in FIGS. 1 and 3 to define a lip 150. In an embodiment, the lip may support fasteners, such as snaps 120. Other fasteners may include a circumferential zipper or hook and pile (VECLRO®) strips.

Various packings may be used in the upper pillow to achieve a desired blend of tactile feel, rebound, density, and compressibility. Typical pillow filling materials include synthetic plastic fibers, feathers, down, foam rubbers, and latex. Different stuffing materials will have different physical properties. For example, down filling may have low density and more compressibility (i.e., softness) than a polyester filling. A cotton filling may have a greater density than and less compressibility (i.e., less soft) than polyester. The quantity of a resilient filling like down or polyester in the pillow can be varied to give upper pillows of varying density, compressibility, and rebound.

The upper pillow may be about 1" thick to about 4" thick (about 2.5 cm to about 10.2 cm) at the widest part, or about 2" thick to about 3" (about 5.1 to about 7.6 cm) thick, or about 2.5" (6.4 cm) thick. The upper section has an impact surface 130 facing up. The drum sticks 300, shown in the hands of a user (FIG. 4), strike the impact surface in use.

In an embodiment, the lower pillow 200 is packed with a heavy flowable material such as, for example, sand or ball bearings. The heavy flowable material acts as a weight to prevent the pillow assembly from shifting position or moving during use. The weight acts as an anchor to keep the practice pillow assembly stationary during use.

In an embodiment, the lower section 200 is a double-skin pillow with a coarse outer material 210 such as canvas, which has non-slip (non-skid) surface properties that further help to reduce any tendency for the practice pillow to shift or move during use. The lower section may have in inner skin (not shown) made from a material like muslin with a tight weave. In an embodiment where the lower section is packed with a fine mesh weighted material such as sand, a tight weave material is desirable to prevent leakage of the sand.

In an embodiment, the lower pillow 200 may have a seam 255 and a lip 250 to match a corresponding and overlapping lip 150 on the upper pillow. In an embodiment, fasteners, for example snaps 120, may be affixed to lip 250.

In an embodiment, the lower pillow 200 is about 0.5" to 1" thick, or about 0.5" thick, and is packed with about 0.5 lbs. to about 10 lbs. (about 0.23 kg to about 4.5 kg) of weighted material, or about 1 lbs. to about 4 lbs. (about 0.45 kg to about 1.8 kg), or about 2 lbs. to about 3 lbs. (about 0.9 kg to about 1.4 kg) of weighted material. In an embodiment, the lower pillow is packed with about 2.5 lbs. (about 1.1 kg) of weighted material.

The amount of weighted material is balanced between an amount to sufficiently anchor the practice pillow pad in place during use, but not so much as to make the practice pillow pad assembly unwieldy or uncomfortably heavy. An important advantage in some embodiments of the inventive practice pillow is that it may be highly portable and easily carried for use outside of the user's home or practice studio. A weight of about 2.5 lbs. may be a good balance between sufficient weight to functionally anchor the pad, yet light enough to be easily transportable. Other embodiments may be heavier and intended for stationary use.

In an embodiment, the bottom of surface 230 of the pillow assembly may be made from a rubberized material to further minimize slipping tendencies and keep the assembly stationary in use.

In an embodiment, the upper and lower sections are detachable. The two sections may be fastened together with hook and loop fasteners (for example, VELCRO®), a zipper, or snaps. In an embodiment, eight equally spaced snaps are used. In the figures, snaps (120) are used to fasten the two pillow sections. In an embodiment, eight snaps may be used, as illustrated in FIG. 3, showing the bottom 115 of upper pillow 100, with the snaps arranged on a circumferential lip 150 of the upper pillow. Lip 150 is defined by seam 155 which defines the edge of the stuffed part of the pillow.

By having detachable pillow sections, the two sections can be, for example, cleaned independently, or swapped out. For example, the impact surface may wear out under heavy use, and a user can replace the upper pillow. In another embodiment, different upper pillows with different playing characteristics may be used, that can be easily snapped in and out of place. In another embodiment, different weights and materials may be available for the lower pillow, for example, with heavier or lighter weights.

Figure 4:
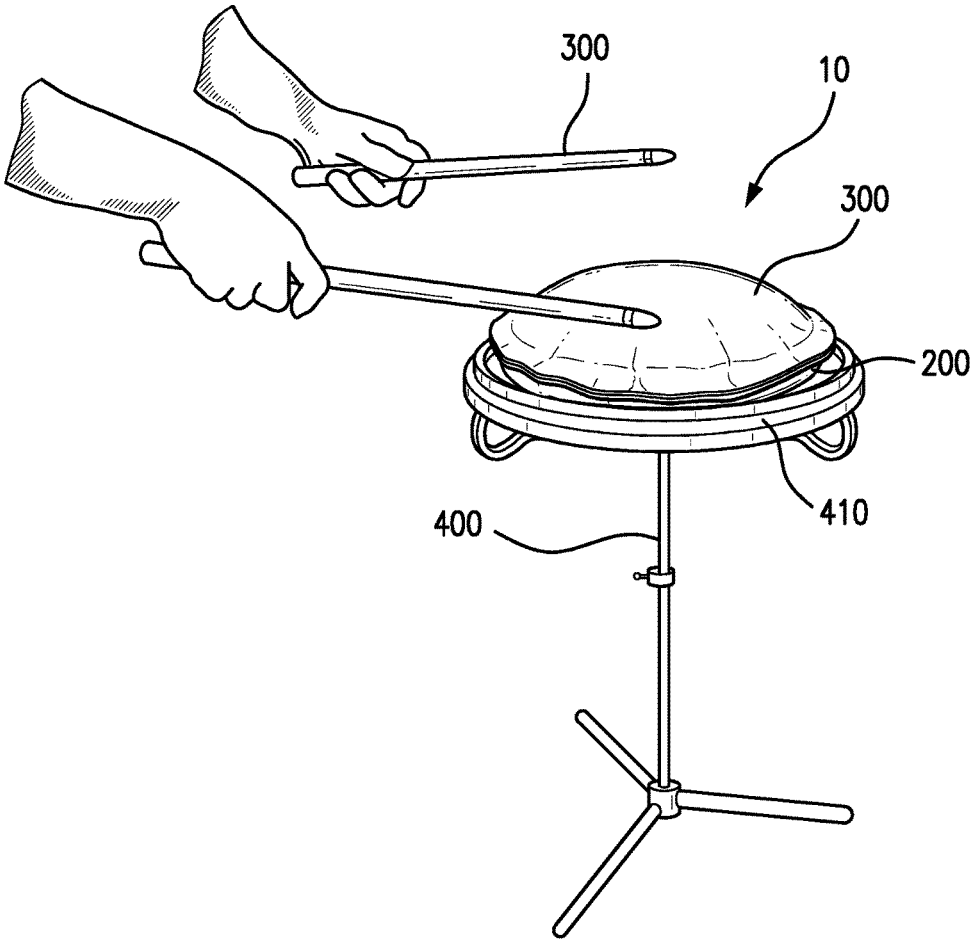
FIG. 4 is a perspective view of the inventive practice pillow pad in use.

In operation, the practice pillow pad 10 is placed on a surface such as the top of a drum (lowered to an appropriate height), or a chair, or a low table (about 18-20" high). The pillow can also be placed in the lap or on a one leg of the user. FIG. 4 illustrates the practice pillow pad 10 placed on a conventional snare drum 410 on drum stand 400. The user can then practice their drumming technique on the non-rebound surface 130 of the practice pillow pad 10. The inventive practice pillow pad 10 is more comfortable than a conventional pillow because the weighted lower pillow prevents the practice pillow pad 10 from moving during use, which can be a problem with a conventional pillow. Additionally, the practice pillow pad 10 may be appropriately sized and shaped for the purpose of drumming practice.

The invention claimed is:

1. A pillow assembly for practicing drums comprising a. discrete upper and lower sections, wherein each section is a pillow having a generally circular shape on the horizontal axis and wherein the two sections are fastened together in a stacked orientation;

b. wherein the upper section has a fabric outer shell and is packed with a resilient material, and has an impact surface facing up; and c. wherein the lower section has a coarse fabric outer shell made from a non-skid material, and is packed with a heavy flowable material selected from sand or ball bearings.

2. The two section pillow assembly of claim 1, wherein the diameter of each pillow is about 8" to about 16" in diameter.

3. The two section pillow assembly of claim 1, wherein the diameter of each pillow is about 12" in diameter.

4. The two section pillow assembly of claim 1, wherein the upper pillow has a cotton/polyester blend outer shell.

5. The two section pillow assembly of claim 1, wherein the upper pillow is stuffed with a polyester fiber fill.

6. The two-section pillow assembly of claim 1, wherein the bottom surface is made from a non-slipping material.

7. The two-section pillow assembly of claim 1, wherein the bottom surface is rubberized.

8. The two-section pillow assembly of claim 1, wherein the upper section is about 1" to about 4" thick at the thickest part.

9. The two-section pillow assembly of claim 1, wherein the upper section is about 2.5" thick at the thickest part.

10. The two-section pillow assembly of claim 1, wherein the lower section is about 0.5" to about 1.0" thick at the thickest part.

11. The two-section pillow assembly of claim 1, wherein the lower section is about 0.5" thick at the thickest part.

12. The two section pillow assembly of claim 1, wherein the upper and lower sections are detachable.

13. The two-section pillow assembly of claim 1, wherein the upper and lower sections are fastened with a fastener selected from a plurality of snaps, hook and pile connectors, and a circumferential zipper.

14. The two-section pillow assembly of claim 1, wherein the total weight of the two-section pillow is about 0.5 lbs. to about 10 lbs.

15. The two-section pillow assembly of claim 1, wherein the total weight of the two-section pillow is about 2.5 lbs.

16. A method of practicing playing drums, comprising the pillow assembly of claim 1 wherein a drummer practices by striking the impact surface of the assembly with drum sticks.

* * * * *